US008678547B2

(12) United States Patent
Nitta

(10) Patent No.: US 8,678,547 B2
(45) Date of Patent: Mar. 25, 2014

(54) INKJET RECORDING DEVICE, INKJET RECORDING METHOD, AND INKJET HEAD CLEANING DEVICE

(75) Inventor: Noboru Nitta, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 421 days.

(21) Appl. No.: 13/035,608

(22) Filed: Feb. 25, 2011

(65) Prior Publication Data

US 2012/0056935 A1 Mar. 8, 2012

(30) Foreign Application Priority Data

Sep. 3, 2010 (JP) ..... 2010-198157

(51) Int. Cl.
*B41J 2/165* (2006.01)

(52) U.S. Cl.
USPC ..... 347/33; 347/29; 347/30

(58) Field of Classification Search
USPC ..... 347/22, 29–37, 40, 45–47, 60, 89–90
See application file for complete search history.

(56) References Cited

U.S. PATENT DOCUMENTS

| | | | | |
|---|---|---|---|---|
| 5,670,996 | A | 9/1997 | Mitani | |
| 7,753,474 | B2 * | 7/2010 | Hiruma et al. | 347/29 |
| 7,887,157 | B2 * | 2/2011 | Shimazaki | 347/29 |

FOREIGN PATENT DOCUMENTS

| | | | |
|---|---|---|---|
| JP | 02-095862 | A | 4/1990 |
| JP | 2001-260392 | A | 9/2001 |
| JP | 2005-028675 | | 2/2005 |

* cited by examiner

*Primary Examiner* — Thinh Nguyen
(74) *Attorney, Agent, or Firm* — Patterson & Sheridan, L.L.P.

(57) ABSTRACT

According to one embodiment, an inkjet recording device includes a cleaning member which faces a nozzle surface of an inkjet head and moves along a row of nozzles, a control device which controls ones of the nozzles to partially discharge ink, the ones of the nozzles positioning in an area which the cleaning member faces when the cleaning member moves, and an ink retaining part which retains the ink between the cleaning member and the nozzle surface of the inkjet head which faces the cleaning member.

19 Claims, 3 Drawing Sheets

INKJET RECORDING DEVICE, INKJET RECORDING METHOD, AND INKJET HEAD CLEANING DEVICE

CROSS-REFERENCE TO RELATED APPLICATIONS

This application is based upon and claims the benefit of priority from Japanese Patent Application No. 2010-198157, filed on Sep. 3, 2010, the entire contents of which are incorporated herein by reference.

FIELD

Embodiments described herein relate generally to an inkjet recording device which discharges ink from nozzles of an inkjet head, an inkjet recording method thereof, and an inkjet head cleaning device thereof.

BACKGROUND

An inkjet recording device discharges ink from nozzles of an inkjet head. When ink is discharged continuously, the ink sticks to and stains a nozzle surface where outlets of the nozzles are provided. The stained nozzle surface attracts ink to be discharged or makes ink wetly spread over the nozzle surface, involving a problem that ink does not reach a paper sheet or stains the paper sheet.

Therefore, a nozzle surface of an inkjet head is cleaned periodically. In cleaning, the nozzle surface is once soaked with ink, and then, the ink is removed together with the stains by a cleaning member.

A method for soaking the nozzle surface with ink is either to apply positive pressure to the ink from an ink feeding side so as to overflow, or to seal and apply negative pressure to the nozzle surface so as to suction the ink out to stick to the nozzle surface.

However, a whole of the nozzle surface is simultaneously soaked with the ink, and cleaning is then started. Therefore, the ink drips from the nozzle surface before a cleaning member finishes moving along the nozzle surface. Consequently, there has been a problem that the ink is wasted and stains periphery, or that an amount of ink which soaks the nozzle surface cannot be controlled appropriately, resulting in poor cleaning.

DETAILED DESCRIPTION

In general, according to one embodiment, an inkjet recording device comprises: an inkjet head which comprises plural nozzles arranged in a predetermined direction (in which the nozzle are arranged) in a nozzle surface and forming a nozzle row, and which discharges ink from the row of nozzles; a cleaning member which faces the nozzle surface of the inkjet head and moves along the row of nozzles; a control device which controls ones of the nozzles to partially discharge the ink, the ones of the nozzles positioning in an area which the cleaning member faces when the cleaning member moves; and an ink retaining part which retains the ink between the cleaning member and the nozzle surface of the inkjet head which faces the cleaning member.

Hereinafter, the embodiment will be described in details with reference to the drawings.

Figure 1:
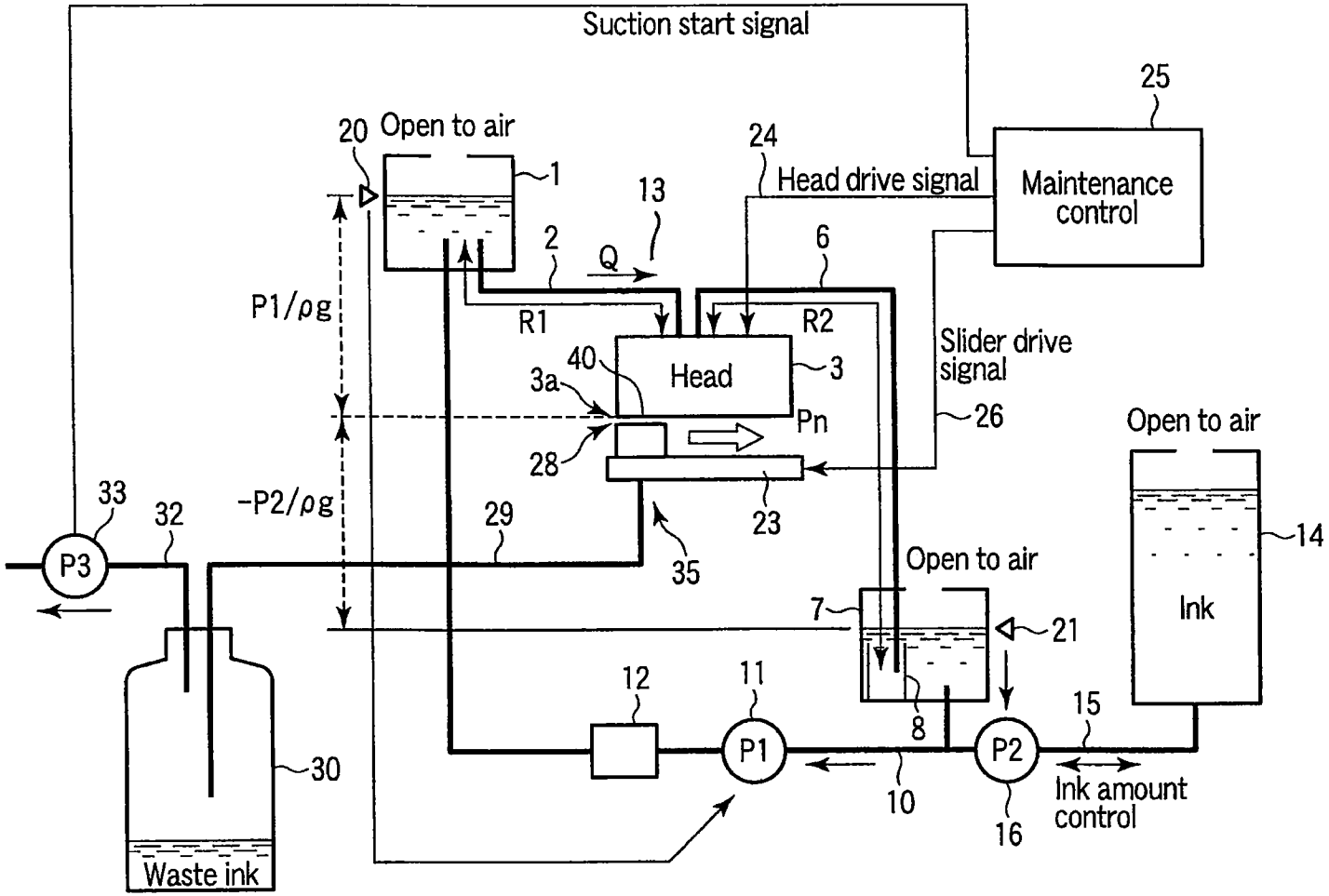
FIG. 1 is a block diagram showing an inkjet recording device according to an embodiment.

FIG. 1 shows the inkjet recording device of an ink circulation type according to the embodiment.

In the figure, reference numeral 1 denotes an upstream sub-tank which is open to air. The upstream sub-tank 1 is connected to an inkjet head 3 through an upstream flow channel 2.

The inkjet head 3 is also connected to a downstream sub-tank 7 through a downstream flow channel 6. The downstream sub-tank 7 is also open to air. A deceleration bottle 8 is provided at an inflow port of the downstream sub-tank 7.

An unillustrated nozzle branch point exists in the inkjet head 3. The upstream flow channel 2 and downstream flow channel 6 and a channel communicating with nozzles are connected at this point.

The deceleration bottle 8 reduces a flow speed of ink flowing into the downstream sub-tank 7, and makes the ink to flow upward. Even when air is mixed in the ink, the air can be released to an atmosphere from a liquid surface of ink in the downstream sub-tank 7.

The downstream sub-tank 7 is connected to the upstream sub-tank 1 through a return flow channel 10. In the middle of the return flow channel 10, a first pump 11 and a filter 12 are provided in this order along a flow direction of the ink.

Thereby the upstream sub-tank 1, the upstream flow channel 2, the inkjet head 3, the downstream flow channel 6, the downstream sub-tank 7, and the return flow channel 10 constitute a circulation channel 13.

To an inflow side of the first pump 11, a main tank 14 which is open to air is connected through an ink-amount control channel 15. A second pump 16 is provided in the middle of the ink-amount control channel 15.

The first pump 11 described above is a circulation pump and returns ink from the downstream sub-tank 7 to the upstream sub-tank 1 when an upper liquid-level sensor 20 detects a liquid surface of ink in the upstream sub-tank 1 to have lowered. The second pump 16 is an ink amount control pump and refills the circulation channel 13 with ink from the main tank 14.

In a gravitational direction the upstream sub-tank 1 is provided at a first position, and the inkjet head 3 is provided at a second position lower than the first position. The downstream sub-tank 7 is provided at a third position lower than the second position.

Figure 3:
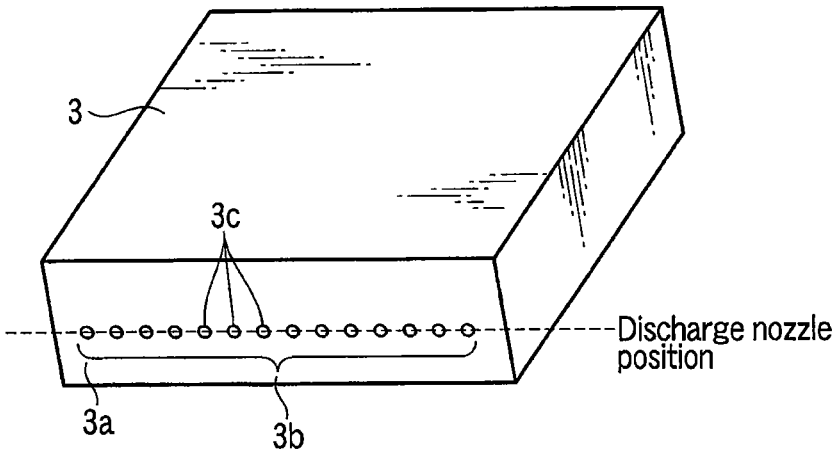
FIG. 3 is a perspective view showing the inkjet head in FIG. 1.

FIG. 3 is a perspective view showing the inkjet head 3 described above.

The inkjet head 3 comprises a nozzle surface 3*a* as in a lower surface side, and plural nozzles 3*c* are provided in the nozzle surface 3*a*. The plural nozzles 3*c* are arranged at a predetermined interval along a direction, thereby constituting a nozzle row.

In a configuration as described above, the first and second pumps 11 and 16 are operated to circulate ink. The inkjet head 3 is thereby supplied with ink, which is discharged from the inkjet head 3 under control of head drive signal 24.

A concentration of ink is expressed as ρ (kg/m3), and a gravitational acceleration is expressed as g ($m/s^2$). A difference in height between the liquid surface of ink in the upstream sub-tank 1 and the nozzle surface 3*a* of the inkjet head 3 is then expressed as P1/ρg (m), and a difference in height between the nozzle surface 3*a* of the inkjet head 3 and the liquid surface of ink in the downstream sub-tank 7 is expressed as −P2/ρg (m).

At this time, the ink in the upstream sub-tank 1 has an "energy per unit volume" P1 (Pa) in relation to, as a reference, ink under an atmospheric pressure at the height of the nozzle surface 3*a*. The ink in the downstream sub-tank 7 has an "energy per unit volume" P2 (Pa) in relation to the same reference as above. Here, Pa (pascal) is a unit for "energy per unit volume" and is equivalence to a pressure unit.

In the configuration as illustrated, the liquid surface of ink in the upstream sub-tank 1 is higher than the nozzle surface 3*a*, and the liquid surface of ink in the downstream sub-tank 7 is lower than the nozzle surface 3*a*. Therefore, P1 and P2 are respectively positive and negative values though not limited to these signs.

A flow channel resistance of the upstream flow channel 2 from the upstream sub-tank 1 to the nozzle branch point in the inkjet head 3 is expressed as R1 (Pa*sec/$m^3$). A flow channel resistance of the downstream flow channel 6 from the nozzle branch point to the downstream sub-tank 7 is expressed as R2 (Pa*sec/$m^3$). Then, ink flows through the circulation channel 13 at a flow rate:

$$Q(\mathrm{m}^3/\mathrm{sec})=(P1-P2)/(R1+R2)$$

Accordingly, a nozzle pressure Pn is:

$$Pn=P2+(P1-P2)*(R2/(R1+R2))$$

Pn is set to a negative pressure of about −1000 Pa in order to perform excellent printing.

In a lower surface side of the inkjet head 3, a slider 23 is provided. A suction nozzle unit 28 is provided on the slider 23 and movable left to right, or right to left along an arrow direction.

The inkjet head 3 is connected to a maintenance control device 25 through the head-drive signal channel 24. The maintenance control device 25 is connected to the slider 23 through a slider-drive signal channel 26.

The suction nozzle unit 28 is connected to a decompression bottle 30 through a collection channel 29. The decompression bottle 30 is connected to a third pump 33 through a suction channel 32.

The suction nozzle unit 28, slider 23, decompression bottle 30, and third pump 33 constitute a suction mechanism 35 for cleaning the nozzle surface 3*a* of the inkjet head 3. The decompression bottle 30 and third pump 33 are to apply a negative pressure to suction ink from the suction nozzle unit 28.

The suction nozzle unit 28 can be moved in a direction of arranging the nozzles 3*c* in the head 3 by the slider 23. The suction nozzle unit 28 is moved along the nozzle surface 3*a* with a gap of 0.1 mm maintained from the nozzle surface 3*a* of the inkjet head 3.

The maintenance control device 25 is configured to be able to activate the third pump 33 by a suction start signal (an unfixed number). When the third pump 33 is activated, the decompression bottle 33 is decompressed through the suction channel 32, and the gap of 0.1 mm between the suction nozzle 28 and inkjet head 3 is simultaneously decompressed through a collection channel 29.

The maintenance control device 25 can further generate a head drive signal and a slider drive signal. The head drive signal is to drive arbitrary selected ones of unillustrated actuators corresponding to an arbitrary selected ones of the plural nozzles 3*c* of the inkjet head 3, to discharge ink from the one nozzle 3*c*. The slider drive signal is to make the suction nozzle unit 28 scan. The maintenance control device 25 generates the slider drive signal to make the suction nozzle unit 28 perform scanning, and generates the head drive signal to control ink to be discharged only from ones of the nozzles 3*c* in an area facing a suction surface 28*a* of the suction nozzle unit 28.

The maintenance control device 25 is also configured to be able to receive a head drive signal for normal printing from an unillustrated print control device and to switch the received head drive signal directly into the head drive signal 24.

In the normal printing, the slider 23 is configured to be able to retract the suction nozzle unit 28 back to a place where the suction nozzle unit 28 does not hinder printing.

Figure 2A:
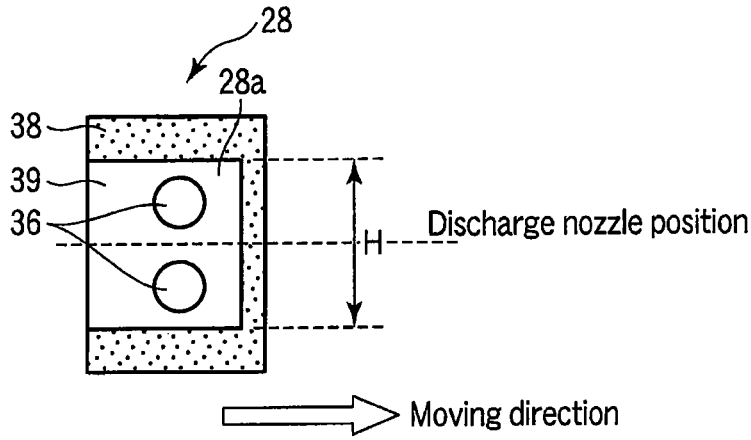
FIG. 2A is a plain view of a suction nozzle unit in FIG. 1, viewed from a side of nozzles of an inkjet head.

FIG. 2A is a plain view where the suction surface of the suction nozzle unit 28 is viewed from an upper side of FIG. 1.

An ink repellant part 38 is formed along two side parts and an end part of the suction surface 28*a* of the suction nozzle unit 28. An ink-philic part 39 is formed on an area surrounded by the ink repellent part 38. The ink-philic part 39 stores ink ejected from the nozzles, and cleaning is performed within a range of the ink-philic part 39 as will be described later.

Further, a pair of suction ports 36 are cut in the ink-philic ink part 39. The suction ports 36 are arranged so as not to face the nozzle row 3*b*. Specifically, there is a positional relationship that the nozzle row 3*b* faces a center between the pair of suction ports 36 when the suction nozzle unit 28 scans along the nozzle surface 3. This positional relationship is intended not to directly supply ink discharged from the nozzles to the decompression bottle 30 but to temporarily store the ink into the ink-philic part 39.

Figure 2B:
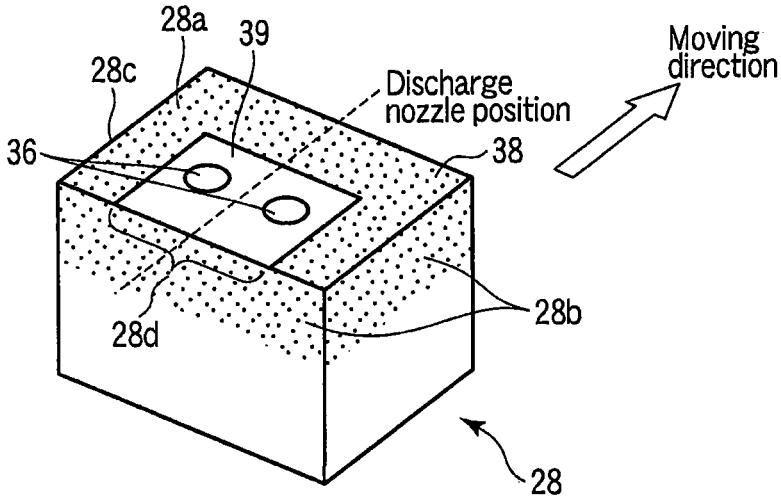
FIG. 2B is a perspective view of the suction nozzle unit in FIG. 1.

FIG. 2B is a perspective view of the suction nozzle unit 28.

Peripheral walls 28*b* of the suction nozzle unit 28 form edges 28*c* at right angles to the suction surface 28*a*, and thereby prevent ink from spreading over the walls. The peripheral walls 28*b* near the edges 28*c* are subjected to an ink repellent treatment.

At least the ink-philic part 39 of the suction surface 28*a* of the suction nozzle unit 28, i.e., a part of the cleaning width H is moved along the nozzle surface 3*a* with a gap of 0.1 mm maintained from the nozzle surface 3*a*. However, an outer part of the cleaning width H of the ink repellent part 38 does not face vicinity of the nozzles 3*c*, and may therefore be structured to make direct contact with the nozzle surface 3*a*.

Figure 2C:
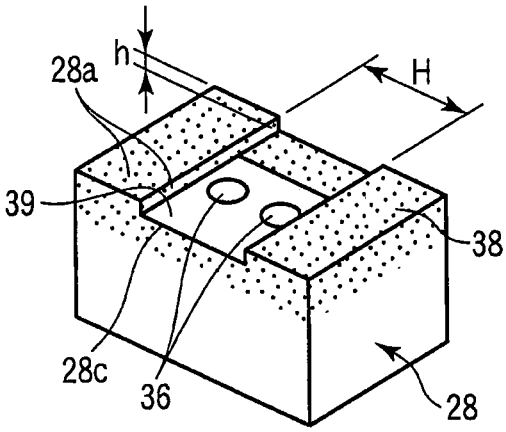
FIG. 2C shows a modification to the suction nozzle unit in FIG. 2B.

That is, for example, as shown in FIG. 2C, an ink-repellent treatment layer of the ink repellent part 38 in the outer part of the cleaning width H is formed to have a thickness h of 0.1 mm. The outer part may be structured such that a gap of 0.1 mm is maintained between the nozzle surface 3*a* and the ink-philic part 39 by the thickness h.

Figure 4:
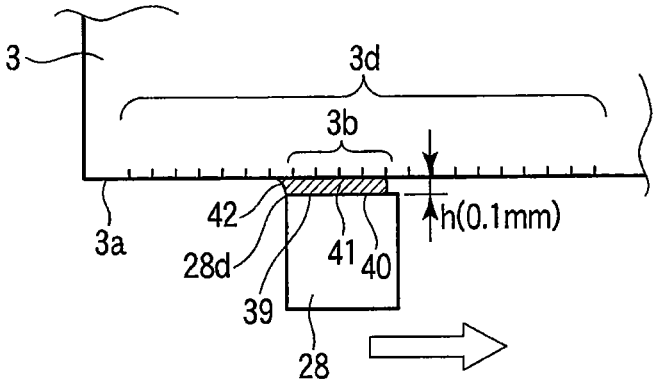
FIG. 4 is a cross-sectional view showing for explaining a nozzle surface of an inkjet head, a suction nozzle unit, an ink retaining part, edges of an ink-philic part, and a meniscus.

FIG. 4 is a cross-sectional view showing for explaining a relationship between the suction nozzle unit 28, ink-philic part 39, edges 28*d* of the ink-philic part, and nozzle surface 3*a* during cleaning.

At first, the maintenance control device 25 activates the third pump 33 by a suction start signal, and decompresses the decompression bottle 30. Next, a slider drive signal and a head drive signal for driving the actuators are generated from the maintenance control device 25. The suction nozzle unit 28 is accordingly moved along the nozzle surface 3*a* of the inkjet head 3, and ink is discharged only from ones 3*b* of the nozzles 3*d* in an area facing the moving suction nozzle unit 28.

In this manner, the gap of 0.1 mm or, namely, an ink retaining part 40 between the ink-philic part 28*d* of the suction nozzle unit 28 and the nozzle surface 3*a* of the inkjet head 3 is filled with ink 41 discharged from the nozzles 3*b* of the inkjet head 3, and the filled ink moves together with the suction nozzle unit 28 in a moving direction.

The ink 41 stored in the ink retaining part 40 forms a meniscus 42 between the edges 28*d* of the ink-philic part and the nozzle surface 3*a*. The meniscus 42 is made scan along the nozzle surface 3*a*, together with the suction nozzle unit 28. A mist of ink and dust which stick to the nozzle surface 3*a* are moved together with the ink 41 stored at the ink retaining part 40 and in the meniscus 42 of edges 28*d* of the ink-philic part, thereby cleaning these mist of ink and dusts on the nozzle surface 3*a*.

An amount of the ink 41 retained in the ink retaining part 40 can be adjusted by controlling one or both of a pressure applied to the decompression bottle 30 and an amount of ink discharged from the nozzle 3*d*. The amount of ink 41 is controlled so as to form a stable meniscus 42 at the edges 28*d* of the ink-philic ink part.

Excessive ink used for cleaning is suctioned into the decompression bottle 30, and the head nozzle surface 3*a* within a corresponding range is cleaned effectively.

In the cleaning, desirably, more ink is discharged within a range from a suction center of the suction nozzle unit 28 in an arrow direction in the figure, which is the moving direction of the slider 23, than within an opposite range in the moving direction, or discharged only within the former range from the suction center in the arrow direction. This is because the ink can not perfectly be removed by suctioning if ink is discharged too much within the range in the opposite direction to the arrow from the suction center of the suction nozzle unit 28.

Alternatively, if a resistance of a flow channel to an atmospheric pressure from the gap part between the suction nozzle unit 28 and the nozzles 3*d* of the inkjet head 3 is set to be large, a pressure at the gap part is reduced by suctioning, and ink is accordingly discharged from the nozzles 3*d*. Therefore, the ink-philic part 39 can be made wet without discharging ink, and a process of driving the actuator to discharge ink can be omitted.

As has been described above, according to the present embodiment, ink is discharged only from the nozzles 3*b* facing the suction nozzle unit 28 which moves along the nozzle surface 3*a* of the inkjet head 3. Therefore, the discharged ink is steadily filled in the gap between the suction nozzle unit 28 and the nozzle surface 3*a*.

Accordingly, cleaning can be efficiently performed without wastefully dripping ink, like a conventional inkjet head which discharges ink from all nozzles in a nozzle surface thereof.

Although the above embodiment employs the suction nozzle unit 28, the embodiment is not limited to this unit but may employ a plate-type wiper blade without a suctioning function.

Figure 5:
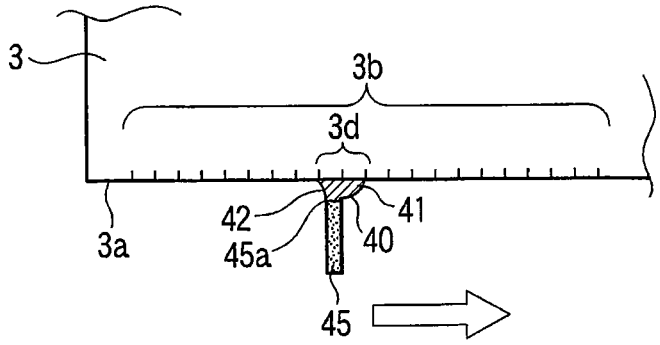
FIG. 5 is a cross-sectional view showing for explaining the nozzle surface and a wiper blade of the inkjet head, the ink holder, an edge of the ink-philic part, and a meniscus.

In FIG. 5, the suction nozzle unit 28 in FIG. 4 is substituted with a wiper blade 45. The wiper blade 45 is ink-philic as a whole. In FIG. 5, a slight gap is maintained between the wiper blade and a nozzle plate. When the wiper blade is made of a soft material which does not damage the nozzle surface 3*a*, however, the wiper blade may be brought into direct contact with the nozzle surface of the inkjet head.

The wiper blade 45 is moved in the direction in which the nozzles are arranged. In synchronism with this movement, actuators which correspond to head nozzles are sequentially driven near the wiper blade 45 and in a forward side in the moving direction, thereby to discharge ink from the nozzles 3*b*. Ink gathers in peripheries of a tip end of the wiper blade 45, forming the ink retaining part 40, and a meniscus 42 is formed between the wiper blade 45 and the nozzle surface 3*a* in the left side in FIG. 5, i.e., in an side opposite to the moving direction. In the figure, reference symbol 45*a* is an edge of the ink-philic part.

If the actuators are driven too frequently, an ink retaining part 40 swells, and excessive ink stains the peripheries. Therefore, the amount of ink may be small or the actuators may be driven intermittently.

An excellent cleaning effect can be achieved by thus moving the ink 41 in the ink retaining part 40 together with the meniscus 42.

The cleaning method as described above is particularly effective for use in an inkjet head of a type in which ink circulates behind a back side of nozzles or in a pressure chamber, from reasons described below.

In an inkjet recording device without ink circulation path using an end shooter type inkjet head, ink in a back side of nozzles or in a pressure chamber flows only in a direction of the nozzles but not in a direction different from the direction of the nozzles.

In such an inkjet recording device of using an end shooter type inkjet head, air bubbles can be generated in a channel while abnormal stop occurs on ejecting.

The air bubbles hinder increase of a pressure of the ink. In this case, the abnormal stop of ink discharge cannot be solved by only cleaning surfaces of the nozzles, but an operation for removing the air bubbles is required separately. Further, in a situation that increase of the pressure is hindered, ink cannot be discharged from the nozzles of the inkjet head even if the actuators of the inkjet head are driven. That is, when air bubbles occur neither behind the back side of the nozzles nor in the pressure chamber, ink can be discharged from the nozzles of the inkjet head by driving the actuators and can be used to perform cleaning. Specifically, recovery from the stop of ink discharge by the mechanism described in the embodiment is available in limited cases for an inkjet recording device of using an end shooter type inkjet head.

In contrast, in the inkjet head of the circulation type capable of pressing out ink and air bubbles from the back side of nozzles or the pressure chamber by a circulation flow, air bubbles never stay behind the back side of nozzles or in the pressure chamber. If air bubbles are generated in the back side of the nozzles or in the pressure chamber, the air bubbles are pressed and flow to a downstream side at a next instance. Therefore, ink can be discharged at any time by moving the actuators. Accordingly, when ink discharge stops abnormally, the inkjet head of the circulation type can be recovered in most cases by only cleaning a nozzle surface by the mechanism described in the embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An inkjet recording device comprising:

an inkjet head which comprises a row of nozzles arranged in a predetermined direction on a nozzle surface and which discharges ink from the row of nozzles;

a cleaning member which faces the nozzle surface of the inkjet head and is configured to move along the row of nozzles;

a control device which controls each of the nozzles to partially discharge the ink when the nozzle faces the cleaning member; and an ink retaining part disposed between the cleaning member and the nozzle surface, the ink retaining part including an ink-philic area facing the nozzle surface and configured to retain ink.

2. The inkjet recording device of claim 1, wherein the cleaning member is a wiper blade, and the control device supplies the inkjet head with a drive signal to control the inkjet head to discharge the ink.

3. The inkjet recording device of claim 1, wherein the cleaning member is a suction nozzle which suctions the ink on the nozzle surface.

4. The inkjet recording device of claim 3, wherein the control device supplies the inkjet head with a drive signal to control the inkjet head to discharge the ink.

5. The inkjet recording device of claim 4, wherein the control device supplies the inkjet head with a drive signal to control the inkjet head to more discharge the ink within an area in a forward side along a moving direction from a suction center of the suction nozzle than within an area in an opposite side along the moving direction.

6. The inkjet recording device of claim 4, wherein the control device supplies the inkjet head with a drive signal to control the inkjet head to discharge the ink only within an area in a forward side along a moving direction from a suction center of the suction nozzle.

7. The inkjet recording device of claim 3, wherein the control device performs a control in a manner that a negative pressure is applied to the suction nozzle to decompress an air gap between the suction nozzle and the row of nozzles of the inkjet head, and that the ink is suctioned from the row of nozzles of the inkjet head.

8. The inkjet recording device of claim 3, wherein the ink-philic area is disposed on a surface of the cleaning member facing the nozzle surface, and the suction nozzle stores the ink discharged from the row of nozzles to the ink-philic area.

9. The inkjet recording device of claim 8, wherein the suction nozzle comprises a suction port in the ink-philic area, and the suction port is provided at a portion which does not face the nozzles of the inkjet head.

10. The inkjet recording device of claim 1, wherein in the inkjet head, the ink behind the nozzles circulates.

11. An inkjet recording device comprising:

an inkjet head which comprises a row of nozzles arranged in a predetermined direction in a nozzle surface and which discharges ink from the row of nozzles;

a cleaning member which faces the nozzle surface of the inkjet head;

a slider which mounts the cleaning member and moves the cleaning member along the row of nozzles;

a control device which supplies the inkjet head with a drive signal when the cleaning member is moved, to control each of the nozzles to partially discharge the ink when the nozzle faces the cleaning member; and a collection device which collects the ink subjected to cleaning by the cleaning member.

12. The inkjet recording device of claim 11, wherein the cleaning member is a suction nozzle which suctions the ink on the nozzle surface.

13. The inkjet recording device of claim 12, wherein the collection device comprises a collection vessel which is connected to the slider through a collection channel and collects the ink suctioned by the suction nozzle.

14. The inkjet recording device of claim 13, further comprising a suction pump which is connected to the collection vessel through a suction channel.

15. An inkjet recording method comprising:

making a cleaning member face a nozzle surface of an inkjet head which discharges ink from a row of nozzles arrayed in a predetermined direction in the nozzle surface;

cleaning the nozzle surface by moving the cleaning member along the row of nozzles; and supplying the inkjet head with a drive signal when the cleaning member is moved, to control each of the nozzles to partially discharge the ink when the nozzle faces the cleaning member.

16. The inkjet recording method of claim 15, wherein the cleaning member sucks the ink on the nozzle surface while cleaning.

17. A cleaning device for an inkjet recording device, comprising:

a cleaning member comprising an ink-philic part facing a part of a nozzle surface of an inkjet head which comprises a row of nozzles arranged in a predetermined direction in the nozzle surface and is capable of discharging ink from the row of nozzles, the cleaning member being movable along the row of nozzles while maintaining a predetermined gap between the nozzle surface and the ink-philic part; and a control device which makes ones of the nozzles of the inkjet head discharge the ink into the gap between the nozzles surface and the cleaning member, thereby forming an ink retaining part and a meniscus at edges of the cleaning member, and which simultaneously moves the cleaning member along the nozzle surface.

18. The cleaning device of claim 17, wherein the control device supplies the inkjet head with a head drive signal.

19. The cleaning device of claim 17, wherein the control device suctions the ink from ones of the nozzles of the inkjet head which face the ink-philic part, by decompressing the gap between the nozzle surface and the ink-philic part.

* * * * *